US011390481B2

(12) United States Patent
Kawasaki et al.

(10) Patent No.: US 11,390,481 B2
(45) Date of Patent: Jul. 19, 2022

(54) DOCUMENT CONVEYANCE APPARATUS

(71) Applicant: KYOCERA Document Solutions Inc., Osaka (JP)

(72) Inventors: Kenichiro Kawasaki, Osaka (JP); Yoshiaki Tashiro, Osaka (JP); Yoshitaka Tokoro, Osaka (JP); Takafumi Nakagawa, Osaka (JP); Hirofumi Hagihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 192 days.

(21) Appl. No.: 17/034,227

(22) Filed: Sep. 28, 2020

(65) Prior Publication Data

US 2021/0101769 A1 Apr. 8, 2021

(30) Foreign Application Priority Data

Oct. 3, 2019 (JP) ..... JP2019-183203

(51) Int. Cl.
*B65H 31/22* (2006.01)
*B65H 31/24* (2006.01)
*B65H 29/58* (2006.01)

(52) U.S. Cl.
CPC ..... *B65H 31/24* (2013.01); *B65H 29/58* (2013.01); *B65H 31/22* (2013.01)

(58) Field of Classification Search
CPC ..... B41J 13/0063; H04N 1/0423; B65H 2405/31; B65H 29/62; B65H 31/22
See application file for complete search history.

(56) References Cited

U.S. PATENT DOCUMENTS 7,212,751 B2 * 5/2007 Kayama ..... B65H 31/02 399/21
7,942,414 B2 * 5/2011 Taki ..... G03G 15/6552 271/279
9,571,690 B2 * 2/2017 Osanai ..... H04N 1/0423
11,252,294 B2 * 2/2022 Nakagawa ..... B65H 29/60
(Continued)

FOREIGN PATENT DOCUMENTS

JP 2000-026003 A 1/2000
JP 3648956 B2 * 5/2005
(Continued)

*Primary Examiner* — Howard J Sanders
(74) *Attorney, Agent, or Firm* — Studebaker & Brackett PC

(57) ABSTRACT

A document conveyance apparatus includes a first conveyance path, a first image reading part, a curved second conveyance path, a third conveyance path, a branch guide, a first discharge port, a document stacking section, a second discharge port and a tray support part. The first conveyance path extends linearly. The curved second conveyance path is branched from the first conveyance path at a branch point. The third conveyance path is branched from the first conveyance path at the branch point and extends linearly. Through the first discharge port, the document conveyed along the second conveyance path is discharged. The document stacking section is provided with a discharge tray. Through the second discharge port, the document conveyed along the third conveyance path is discharged. To the tray support part, the detached discharge tray is supported such that the document discharged through the second discharge port is stacked.

6 Claims, 5 Drawing Sheets

(56) References Cited

U.S. PATENT DOCUMENTS

| | | | | |
|---|---|---|---|---|
| 2011/0052289 | A1* | 3/2011 | Ogasawara | B65H 5/38<br>271/226 |
| 2019/0283991 | A1* | 9/2019 | Noda | B65H 5/26 |

FOREIGN PATENT DOCUMENTS

| | | | | |
|---|---|---|---|---|
| JP | 4279382 | B2 * | 6/2009 | |
| JP | 4870901 | B2 * | 2/2012 | B65H 31/20 |
| JP | 2018198359 | A * | 12/2018 | |
| JP | 2018203478 | A * | 12/2018 | |
| JP | 6693472 | B2 * | 5/2020 | |

* cited by examiner

DOCUMENT CONVEYANCE APPARATUS

INCORPORATION BY REFERENCE

This application is based on and claims the benefit of priority from Japanese Patent application No. 2019-183203 filed on Oct. 3, 2019, which are incorporated by reference in its entirety.

TECHNICAL FIELD

The present disclosure relates to a document conveyance apparatus which reads an image of a document while conveying the document.

BACKGROUND

With a computerization of a document depending on a trend for paperless system in recent years, a quality and a function of a document reading device (DP) of a multifunctional peripheral (MFP) are being developed. In particular, it is required for the document reading device to cope with mediums having various weights and sizes. The document reading device is often configured to read an image of the document while conveying the document along a conveyance path curved in a U-shape. Then, a small size document such as a business card and a card, or a hard document having a large weight may not be conveyed along the curved conveyance path smoothly.

Then, an automatic document conveyance apparatus capable of reading an image of a medium having a business card size is sometimes configured to have a document escape part (an opening) formed on the upstream side of a curved conveyance path, through which a hard document having a predetermined width is passed.

However, in the above automatic document conveyance apparatus, because a conveyance path for the document is not linearly but inclined partially, it is difficult for a hard document having a large weight or a small size document to be conveyed smoothly. Furthermore, because the opening is set for a small size document, a size of the document to be read is limited.

SUMMARY OF THE INVENTION

In accordance with one aspect of the present disclosure, a document conveyance apparatus includes a first conveyance path, a first image reading part, a curved second conveyance path, a third conveyance path, a branch guide, a first discharge port, a document stacking section, a second discharge port and a tray support part. The first conveyance path extends linearly, and along which a document placed on a sheet feeding tray is conveyed. The first image reading part reads an image on one face of the document conveyed along the first conveyance path. The curved second conveyance path is branched from the first conveyance path at a branch point on a downstream side of the first reading part in a conveyance direction of the document. The third conveyance path is branched from the first conveyance path at the branch point and extends linearly in a same extending direction as an extending direction of the first conveyance path. The branch guide is provided at the branch point and guides the document to the second conveyance path or to the third conveyance path. Through the first discharge port, the document conveyed along the second conveyance path is discharged. The document stacking section is provided with a discharge tray on which the document discharged through the first discharge port is stacked and a whole or a part of which is detachable. Through the second discharge port, the document conveyed along the third conveyance path is discharged. To the tray support part, the detached whole or part of discharge tray is supported such that the document discharged through the second discharge port is stacked. When the document conveyed along the third conveyance path is discharged through the second discharge port, the whole or part of the discharge tray is detached from the document stacking section and then supported by the tray support part.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, a document conveyance apparatus according to one embodiment of the present disclosure will be described.

Figure 1:
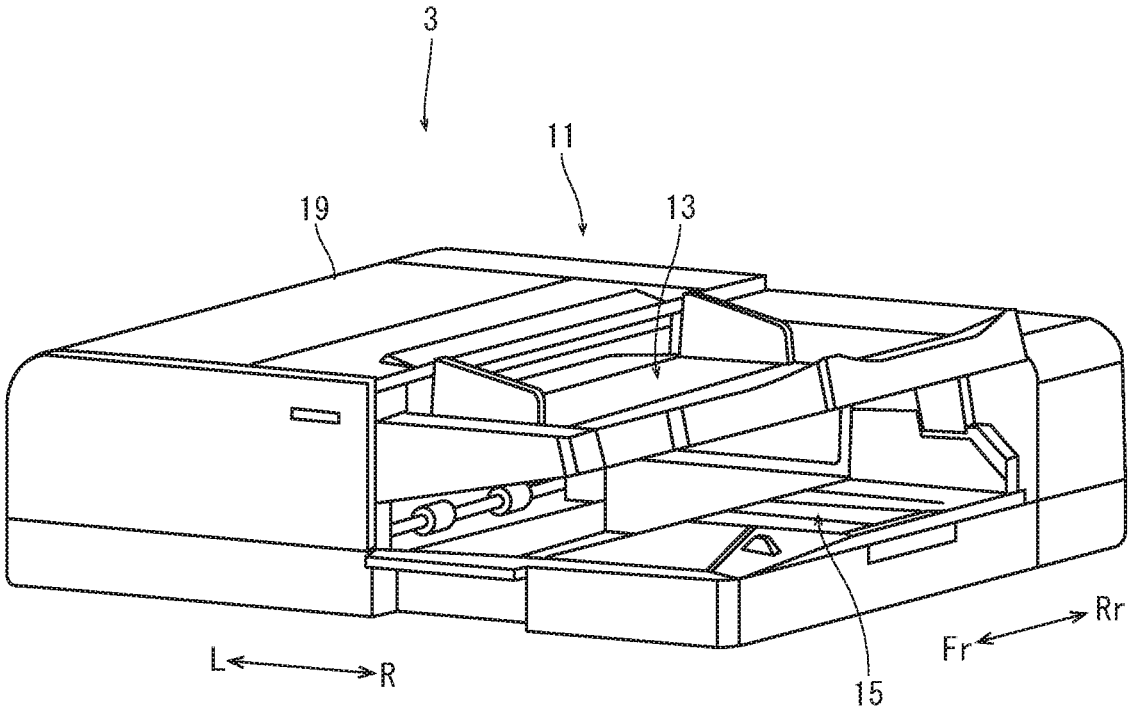
FIG. 1 is a perspective view showing a document conveyance device of a document conveyance apparatus according to one embodiment of the present disclosure.
Figure 2:
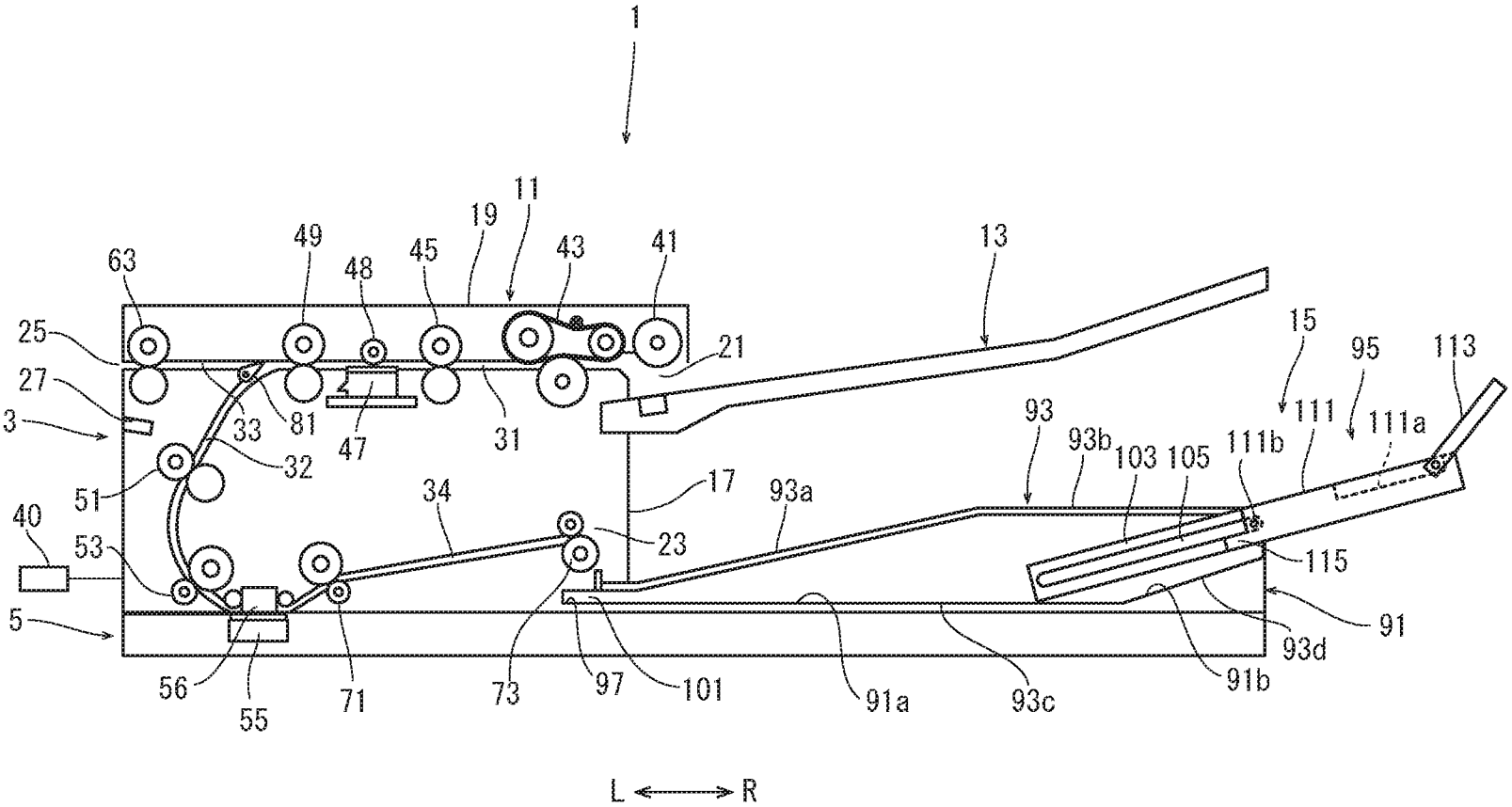
FIG. 2 is a sectional view schematically showing the document conveyance apparatus (at a conveyance of a normal document) according to the embodiment of the present disclosure.
Figure 3:
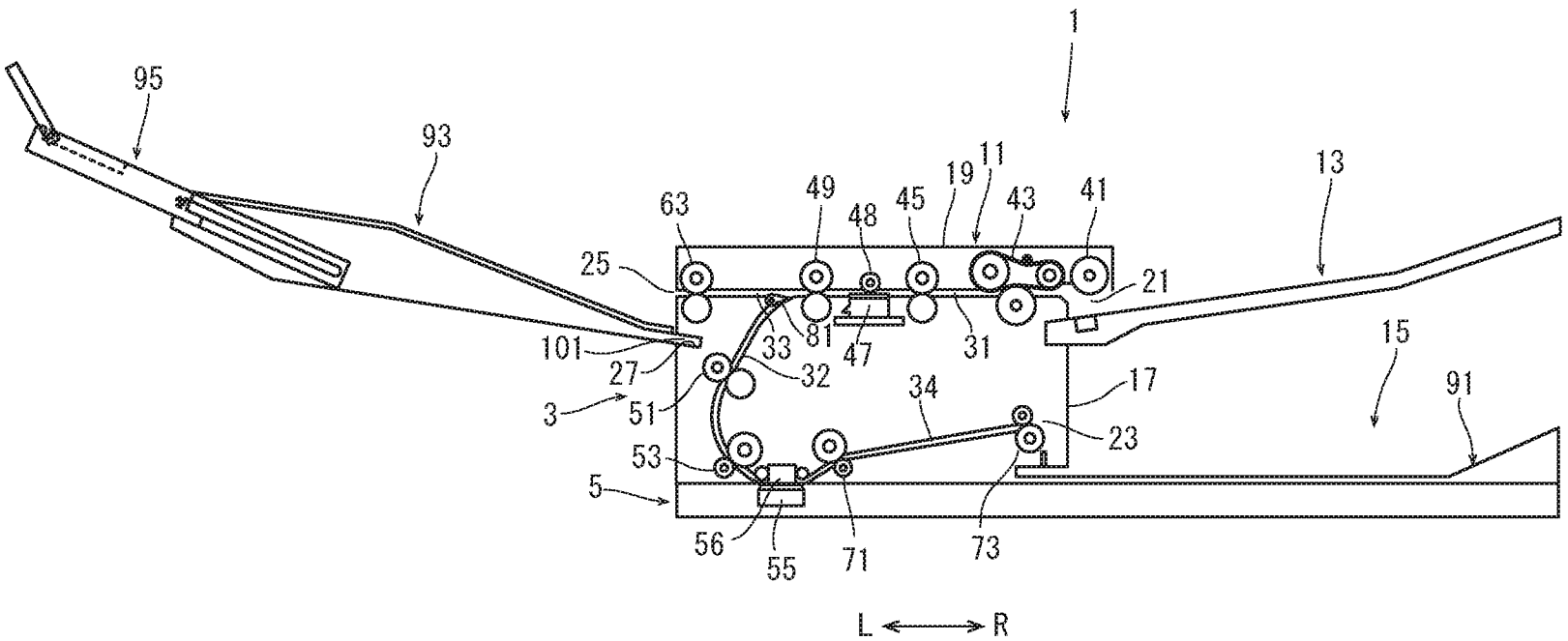
FIG. 3 is a sectional view schematically showing the document conveyance apparatus (at a conveyance of a special document) according to the embodiment of the present disclosure.

With reference to FIG. 1 to FIG. 3, the document conveyance apparatus 1 will be described. FIG. 1 is a perspective view showing a document conveyance device 3 of the document conveyance apparatus 1, and FIG. 2 and FIG. 3 are sectional views showing the document conveyance apparatus 1. Fr, Rr, L and R marked in each figure show a front side, a rear side, a left side and a right side of the document conveyance apparatus 1, respectively.

The document conveyance apparatus 1 is placed on an upper face of an image forming apparatus (not shown), for example. The document conveyance apparatus 1 is configured to convey a document automatically and read images on both faces (the front face and the back face) of the document or an image on one face of the document. The image forming apparatus forms an image corresponding to the image read by the document conveyance apparatus 1 on both faces of a sheet or on one face of a sheet. Alternatively, the document conveyance apparatus 1 is electrically connected to an external computer, and used as a document reading device (a document input device, a scanner).

The document conveyance apparatus 1 includes a document conveyance device 3 and an image reading device 5

(refer to FIG. 2 and FIG. 3). The document conveyance device 3 is supported to the rear end portion of the image reading device 5 in a turnable manner. The detail description of the image reading device 5 is omitted.

The document conveyance device 3 includes a conveyance section 11 which reads an image of the document while conveying the document, a sheet feeding tray 13 on which the document of which the image is read is placed, and a document stacking section 15 on which the document is stacked after the image is read in the conveyance section 11.

As shown in FIG. 2 and FIG. 3, the conveyance section 11 includes an inner guide part 17 and an outer cover 19, and is formed into an approximately parallelepiped shape forming an almost left half portion of the document conveyance device 3 as a whole (refer to FIG. 1 also). The outer cover 19 covers the upper face and the left side face of the inner guide part 17. The outer cover 19 is supported to the left lower corner of the inner guide part 17 in a turnable manner.

On the right side face of the conveyance section 11, a sheet feeding port 21 and a first discharge port 23 are formed. The sheet feeding port 21 is formed between the inner guide part 17 and the outer cover 19. The first discharge port 23 is formed on the right side face of the inner guide part 17 below the sheet feeding port 21. On the left side face of the conveyance section 11, that is, on the left side face of the outer cover 19, a second discharge port 25 and a tray support part 27 are formed. The second discharge port 25 is disposed at almost the same height as the sheet feeding port 21. The tray support part is disposed below the second discharge port 25, and formed into a recess inclined downward toward an inside of the conveyance section 11.

In the conveyance section 11, a conveyance path for the document is formed. The conveyance path contains a first conveyance path 31, a second conveyance path 32, a third conveyance path 33 and a fourth conveyance path 34.

The first conveyance path 31 extends from the sheet feeding port 21 leftward linearly between the inner face of the outer cover 19 and the outer face (the upper face) of the inner guide part 17.

On the first conveyance path 31, a pickup roller 41, a separation roller unit 43, a first upstream side conveyance rollers pair 45, a first image reading unit 47 (a first image reading part), a correction roller 48 and a first downstream side conveyance rollers pair 49 are provided in order from an upstream side of a conveyance direction of the document. The separation roller unit 43 includes a supply belt wound around two pullies and a separation roller coming into contact with the supply belt. Each of the first upstream side conveyance rollers pair 45 and the first downstream side conveyance rollers pair 49 includes a drive roller and a driven roller driven by the drive roller to be rotated. The first image reading unit 47 is an image sensor which reads the image of the document. The correction roller 48 is a drive roller provided with a reflection plate for a shading compensation of the image sensor.

The pickup roller 41, the separation roller unit 43, the drive roller of the first upstream side conveyance rollers pair 45, the first image reading unit 47 and the drive roller of the first downstream side conveyance rollers pair 49 are supported on the outer face of the inner guide part 17. The driven roller of the first upstream side conveyance rollers pair 45, the correction roller 48 and the driven roller of the first downstream side conveyance rollers pair 49 are supported on the inner face of the outer cover 19.

A length L1 between the first upstream side conveyance rollers pair 45 and the first downstream side conveyance rollers pair 49 along the conveyance direction is shorter than a length of a minimum size document (for example, an IC card) capable of being conveyed by the document conveyance apparatus 1.

The second conveyance path 32 is branched from the downstream end of the first conveyance path 31, and extends so as to curve downward in an arc shape between the inner face of the outer cover 19 and the outer face (the left side face) of the inner guide part 17.

On the second conveyance path 32, a second upstream side conveyance rollers pair 51, a second downstream side conveyance rollers pair 53, a second image reading unit 55 (a second image reading part), a correction part 56 are provided in order from an upstream side in the conveyance direction. Each of the second upstream side conveyance rollers pair 51 and the second downstream side conveyance rollers pair 53 includes a drive roller and a driven roller driven by the drive roller to be rotated. The second image reading unit 55 is an image sensor which reads the image of the document. The correction part 56 is a reflection plate for a shading compensation of the image sensor.

The drive roller of the second upstream side conveyance rollers pair 51, the drive roller of the second downstream side conveyance rollers pair 53 and the correction part 56 are supported on the outer face of the inner guide part 17. The driven roller of the second upstream side conveyance rollers pair 51 and the driven roller of the second downstream side conveyance rollers pair 53 are supported on the inner face of the outer cover 19. The second image reading unit 55 is supported by the image reading device 5.

The third conveyance path 33 is branched from the downstream end of the first conveyance path 31, and extends leftward to the second discharge port 25 through the inner guide part 17. The third conveyance path 33 is formed into a linear path along the same left direction as the extending direction of the first conveyance path 31. That is, the first conveyance path 31 and the third conveyance path 33 form a linear conveyance path. Here, the linear shape contains a shape which does not make the conveyed document inverted and bent, and shows a shape capable of conveying a plastic card without resistance (without being curved and bent).

On the third conveyance path 33, a discharge rollers pair 63 is provided. The discharge rollers pair 63 includes a drive roller and a driven roller driven by the drive roller to be rotated. The driven roller of the discharge rollers pair 63 is supported on the upper face of the third conveyance path 33 and the driven roller of the discharge rollers pair 63 is supported on the lower face of the third conveyance path 33.

A length between the first downstream side conveyance rollers pair 49 and the discharge rollers pair 63 along the conveyance direction is shorter than a length of a minimum size document (for example, an IC card) capable of being conveyed by the document conveyance apparatus 1.

The fourth conveyance path 34 is formed from the downstream end of the second conveyance path 32 to the first discharge port 23 along an oblique right upper direction through the inner guide part 17.

On the fourth conveyance path 34, a fourth conveyance rollers pair 71 and a discharge rollers pair 73 are provided in order from an upstream side in the conveyance direction. Each of the fourth conveyance rollers pair 71 and the discharge rollers pair 73 includes a drive roller and a driven roller driven by the drive roller to be rotated.

As described above, the outer cover 19 is supported to the left lower corner of the inner guide part 17 in a turnable manner, when the outer cover 19 is turned downward to cover the outer face (the upper face and the left side face) of the inner guide part 17, the first conveyance path 31 and the second conveyance path 32 are formed between the outer face of the inner guide part 17 and the inner face of the outer cover 19. On the other hand, when the outer cover 19 is turned upward to expose the outer face of the inner guide part 17, the first conveyance path 31 and the second conveyance path 32 are exposed for treatment of a sheet jamming.

In the inner guide part 17, at a branch point between the second conveyance path 32 and the third conveyance path 33, a branch guide 81 is provided. The branch guide 81 guides the document conveyed along the first conveyance path 31 to the second conveyance path 32 or the third conveyance path 33. The branch guide 81 includes a turnable guide plate and a solenoid which turns the guide plate.

The guide plate is a plate member longer in a width direction of the document and shorter in the conveyance direction. A tapered claw-shaped portion is formed in one end portion of the guide plate in the conveyance direction of the document, and a turning shaft along the width direction is provided in the other end portion of the guide plate. The guide plate is disposed with the claw-shaped portion on an upstream side and the turning shaft on a downstream side in the conveyance direction of the document, and turnable around the turning shaft upward and downward. The solenoid is disposed outside the document passing region in the width direction with a rod protruding upward. The tip end of the rod is coupled with the lower face of the guide plate. When the solenoid is not supplied with an electric power, the rod protrudes to turn the guide plate into an upward inclined posture and to guide the document from the first conveyance path 31 to the second conveyance path 32. When the solenoid is supplied with an electric power, the rod is retracted to turn the guide plate into almost a horizontal posture and to guide the document from the first conveyance path 31 to the third conveyance path 33. The solenoid is electrically connected to a controller 40. The solenoid is driven by the controller 40 to protrude or retract the rod.

The sheet feeding tray 13 is supported by the conveyance section 11 in a downward inclined posture toward the sheet feeding port 21.

The document stacking section 15 includes a base part 91, a discharge tray 93 attachable and detachable to and from the base part 91, and a document fall prevention member 95 supported by the discharge tray 93.

The base part 91 is provided integrally with the conveyance section 11 below the sheet feeding tray 13, and formed into a rectangular shape forming an approximately right half of the document conveyance device 3. The upper face of the base part 91 contains a horizontal face 91*a* extending from below the first discharge port 23 along a discharge direction of the document discharged through the first discharge port 23 (rightward) and an inclined face 91*b* inclined upward to a downstream side of the discharge direction. Additionally, on the right side face of the conveyance section 11, a recess 97 continuous to the horizontal face 91*a* of the base part 91 is formed below the first discharge port 23.

The discharge tray 93 is an approximately rectangular shallow hollow member having a document stacking face on which the document discharged through the first discharge port 23 is stacked. The upper face of the discharge tray 93 contains an inclined face 93*a* inclined upward to a downstream side in the discharge direction and an approximately horizontally horizontal face 93*b*. The lower face of the discharge tray 93 contains an approximately horizontally horizontal face 93*c* and an inclined face 93*d* inclined upward to a downstream side along the inclined face 91*b* of the base part.

On the upstream side end face of the discharge tray 93, an insertion protrusion 101 is formed, which is configured to be inserted into the recess 97 formed on the right side face of the conveyance section 11 or into the tray support part 27 (the recess) formed on the left side face of the conveyance section 11. The discharge tray 93 has a storage space 103 in which the document fall prevention member 95 is stored. The storage space 103 is disposed in a center portion in the width direction, formed to be inclined in an oblique upper direction to a downstream side in the discharge direction, and opened to the downstream side end face of the discharge tray 93. On both the side walls of the storage space 103, slits 105 extending in an oblique upper direction to a downstream side in the discharge direction are formed.

The document fall prevention member 95 includes a main body 111 having a size smaller than the discharge tray 93 and a tip end member 113 supported by the main body 111 in a turnable manner. The main body 111 is a rectangular plate-like member. On the downstream end portion of the upper face of the main body 111, a rectangular recess 111*a* is formed at the center portion in the width direction. On each of the side faces of the main body 111, a pin 111*b* is erected. Each pin 111*b* is engaged with each slit 105 of the storage space 103 of the discharge tray 93. Thus, the main body 111 is displaced between a protruding position (refer to FIG. 2) where it is protruded through the opening of the storage space 103 to a downstream side in the discharge direction and a storage position where it is stored in the storage space 103. In the protruding position, the main body 111 is inclined in an oblique upper direction to a downstream side in the discharge direction with respect to the horizontal face 93*b* of the discharge tray 93. On the upstream side end face of the main body 111, an insertion protrusion 115 is formed, which is configured to be inserted into the tray support part 27 formed on the left side face of the conveyance section 11.

The tip end member 113 is a rectangular member having a size smaller than the main body 111. The tip end member 113 is supported in the recess 111*a* formed on the upper face of the main body 111 in a turnable manner between a storage position where it is stored in the recess 111*a* and a protruding position where it is protruded from the downstream side end face of the main body 111 to a downstream side in the discharge direction. In the protruding position, the tip end member 113 is inclined in an oblique upper direction to a downstream side in the discharge direction with respect to the upper face of the main body 111.

In a case where a document to be conveyed has a large size or a case where a document to be discharged through the first discharge port 23 tends to jump out of the discharge tray 93, the main body 111 of the document fall prevention member 95 is displaced to the protruding potion and further the tip end member 113 is turned to the protruding position. Then, a document having a large size or a document jumped out of the discharge tray 93 is supported by the document fall prevention member 95 to prevent the documents from being fallen and jumping out. On the other hand, in a case of a document having a normal size or a document having a tendency that jumping out hardly occurs, the tip end member 113 is turned to the storage position and then the main body 111 is displaced to the storage position.

The document conveyance apparatus 1 is provided with an operation panel (not shown). The operation panel includes a start button for starting the document conveyance operation and the image reading operation and a document selection button for selecting whether the document is a normal document (a plain paper or the others) or a special document (a small size document such as a business card and an IC card, or a document having a large weight). When the normal document is selected from the document selection button, the reading of the both faces of the document is possible, and when a special document is selected from the document selection button, the reading of one face (the back face) of the document is possible.

The operation panel is electrically connected to the controller 40. When the start button is operated, the controller 40 starts the document conveyance operation and the image reading operation. When a special document is selected from the document selection button, the controller 40 supplies an electric power to the solenoid of the branch guide 81.

An example of the document conveyance operation and the image reading operation of the document conveyance apparatus 1 having the above configuration will be described. At the starting of the document conveyance operation and the image reading operation, a user operates the document selection button to select whether the document is a normal document or a special document. When the user selects a normal document, the solenoid of the branch guide 81 is not supplied with an electric power, and the guide plate of the branch guide 81 is kept in the upward inclined posture as shown in FIG. 2. Then, the branch guide 81 is set to guide the document from the first conveyance path 31 to the second conveyance path 32. In the document stacking section 15, the discharge tray 93 is supported by the base part 91, and the insertion protrusion 101 is inserted into the recess 97 of the conveyance section 11. The main body 111 and the tip end member 113 of the document fall prevention member 95 are displaced and turned to their protruding positions as necessary.

Next, the user places the document on the sheet feeding tray 13, and operates the start button of the operation panel to start the document conveyance operation and the image reading operation. The document is fed from the sheet feeding tray 13 by the pickup roller 41, separated one by one by the separation roller unit 43 and then sent to the first conveyance path 31. When the document is conveyed by the first upstream side conveyance rollers pair 45 along the first conveyance path 31 and reaches the first image reading unit 47, an image on the back face of the document is read by the first image reading unit 47. Thereafter, the document is conveyed along the first conveyance path 31 by the first downstream side conveyance rollers pair 49, and then guided to the second conveyance path 32 by the branch guide 81.

When the document is conveyed along the second conveyance path 32 and reaches the second image reading unit 55, an image on the front face of the document is read by the second image reading unit 55. Then, the document is conveyed along the fourth conveyance path 34, and then discharged by the discharge rollers pair 73 through the first discharge port 23. The discharged document is stacked on the discharge tray 93.

On the other hand, when the user selects a special document, the controller 40 supplies an electric power to the solenoid of the branch guide 81 to turn the guide plate of the branch guide 81 to almost the horizontal posture, as shown in FIG. 3. Then, the branch guide 81 is set to guide the document from the first conveyance path 31 to the third conveyance path 33. Furthermore, the user detaches the discharge tray 93 from the base part 91, and then inserts the insertion protrusion 101 of the detached discharge tray 93 into the tray support part 27 below the second discharge port 25.

The user places the document on the sheet feeding tray 13, and operates the start button of the operation panel to start the document conveyance operation and the image reading operation. The document is fed from the sheet feeding tray 13 by the pickup roller 41, separated one by one by the separation roller unit 43 and then sent to the first conveyance path 31. When the document is conveyed by the first upstream side conveyance rollers pair 45 along the first conveyance path 31 and reaches the first image reading unit 47, an image on the back face of the document is read by the first image reading unit 47. Thereafter, the document is conveyed along the first conveyance path 31 by the first downstream side conveyance rollers pair 49, and then guided to the third conveyance path 33 by the branch guide 81. That is, the special document is conveyed linearly from the first conveyance path 31 to the third conveyance path 33.

The document is conveyed along the third conveyance path 33, and then discharged by the discharge rollers pair 63 through the second discharge port 25. The discharged document is stacked on the discharge tray 93.

As described above, according to the document conveyance apparatus 1 of the present disclosure, a special document can be conveyed to read an image thereof along the linear conveyance path formed by the first conveyance path 31 and the third conveyance path 33. Additionally, the discharge tray 93 on which a normal document discharged through the first discharge port 23 is stacked is commonly used as a tray on which a special document discharged through the second discharge port 25 is stacked, so that it becomes possible to receive a special document after the image is read, surely without adding a new member.

In the above embodiment, the discharge tray 93 is provided with the document fall prevention member 95, but may not be provided with the document fall prevention member 95.

Figure 4:
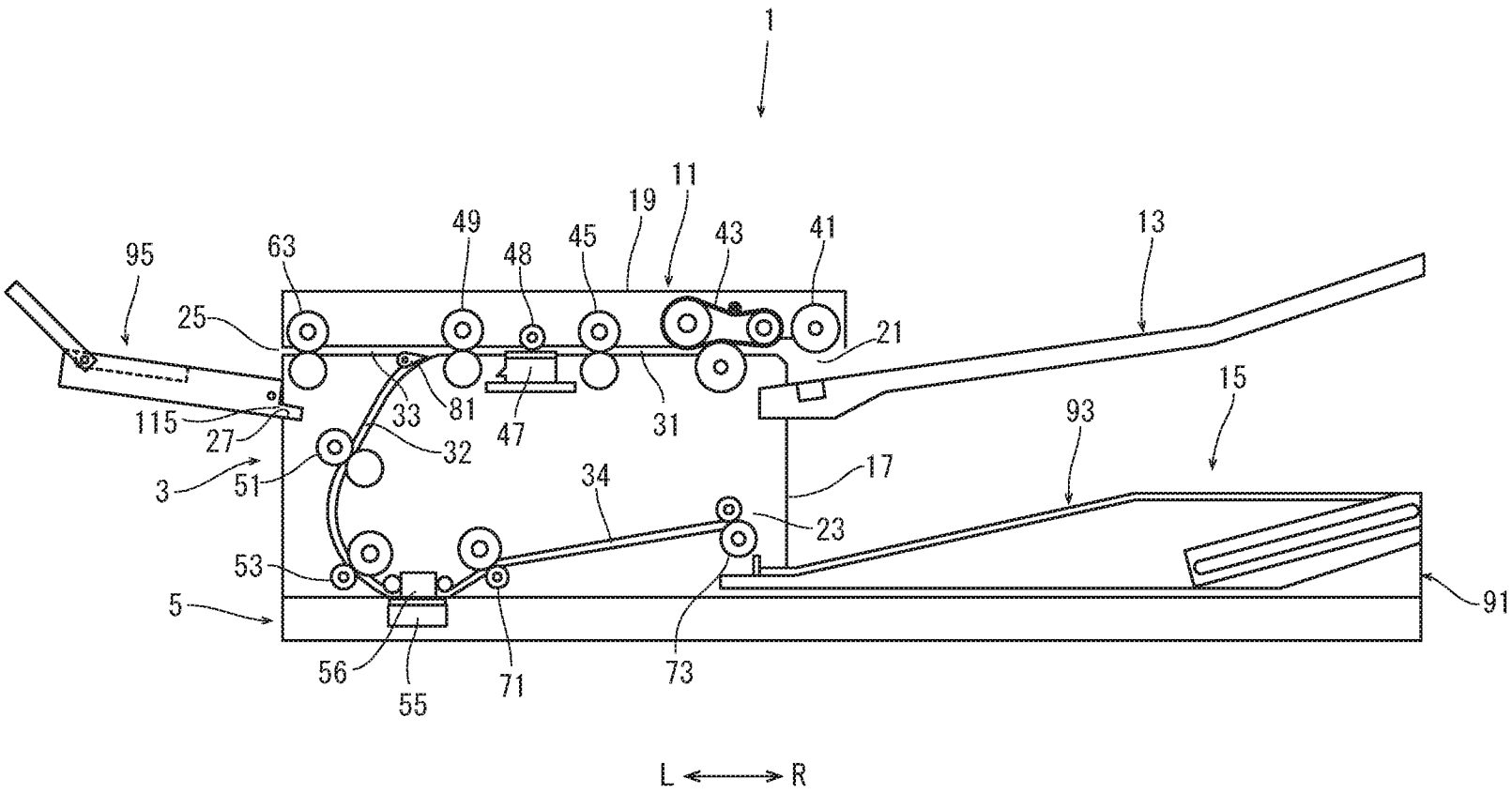
FIG. 4 is a sectional view schematically showing the document conveyance apparatus (at a conveyance of a special document) according to a modified example of the embodiment of the present disclosure.

Next, with reference to FIG. 4, a modified example of the document stacking section 15 of the document conveyance apparatus 1 will be described. FIG. 4 is a sectional view showing the document conveyance apparatus 1.

In the modified example, the discharge tray 93 is fixed to the base part 91 while the document fall prevention member 95 is attachable and detachable to and from the discharge tray 93. In a case of a small size special document, such as an IC card, the user deforms the main body 111 of the document fall prevention member 95 elastically, pulls out each pin **111*b* from each slit 105, and then detaches the document fall prevention member 95 from the discharge tray 93. Then, the user inserts the insertion protrusion 115 of the detached document fall prevention member 95 into the center portion of the tray support part 27 in the width direction of the conveyance section 11. Then, a special document discharged through the second discharge port 25 is stacked on the document fall prevention member 95**.

The document fall prevention member 95 is easily handled and can be supported within a narrow space because of its size smaller than the discharge tray 93. In a case where a special document is limited to a small size document such as an IC card, the modified example is preferable.

The discharge tray 93 may be attachable and detachable to and from the base part 91, and the document fall prevention member 95 may be attachable and detachable to and from the discharge tray 93. In this case, in a case of a special document having a large size, the discharge tray 93 is detached from the base part 91 and then supported by the tray support part 27. In a case of a special document having a small size, the document fall prevention member 95 is detached from the discharge tray 93 and then supported by the tray support part 27. In the above manner, the discharge tray 93 or the document fall prevention member 95 can be selected depending on a size of a document to be conveyed.

In the above embodiments, the discharge tray 93 and the document fall prevention member 95 are supported by the tray support part 27 by inserting their insertion protrusions 101 and 115 into the tray support part 27. However, a way to support the discharge tray 93 and the document fall prevention member 95 is not limited to the above embodiments. For example, they may be supported to the conveyance section 11 using a screw or a pin.

Figure 5:
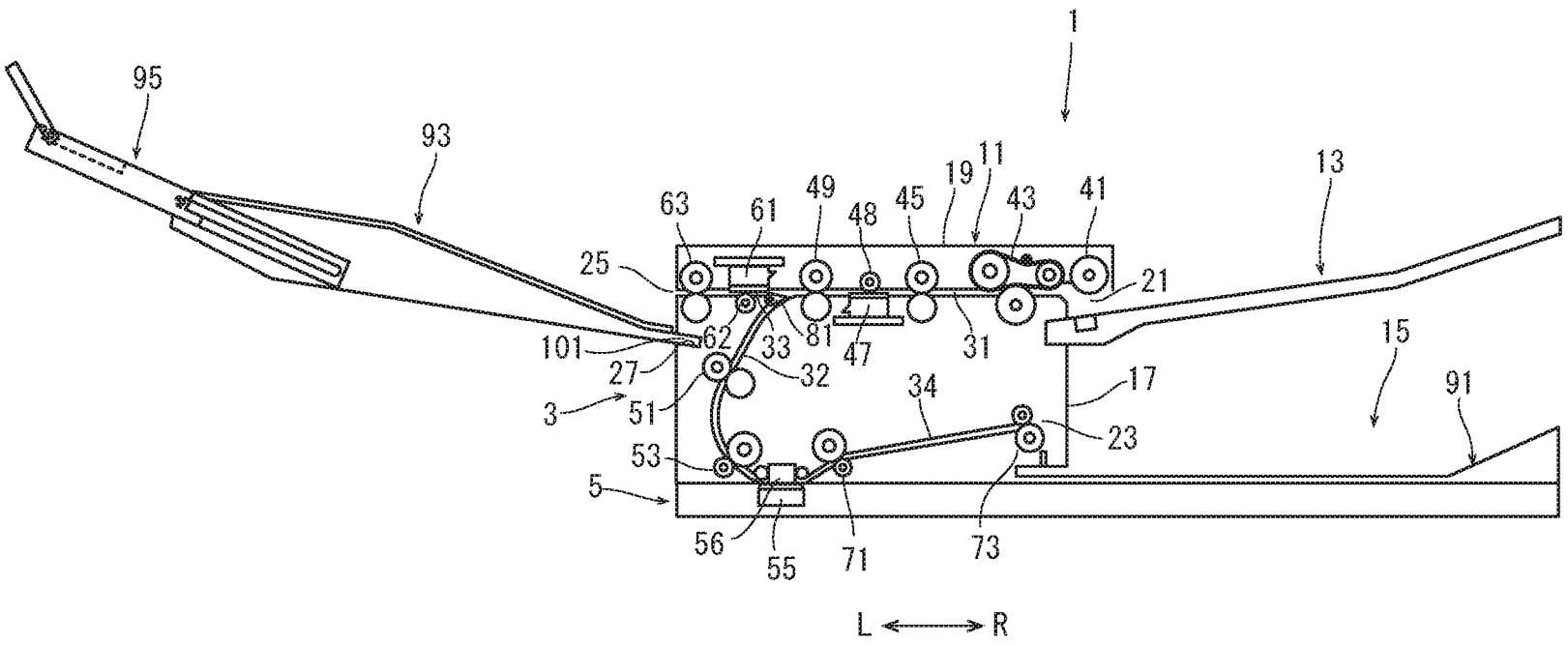
FIG. 5 is a sectional view schematically showing the document conveyance apparatus (at a conveyance of a special document) according to another modified example of the embodiment of the present disclosure.

As shown in FIG. 5, a third image reading unit (a third image reading part) 61 and a correction roller 62 may be provided in the third conveyance path 33. The third image reading unit 61 is an image sensor which reads an image of a document, and the correction roller 62 is a drive roller provided with a reflection plate for a shading correction for the image sensor. The third image reading unit 61 and the correction roller 62 are disposed on an upstream side of the discharge rollers pair 63 in the conveyance direction of the document. In this case, it becomes possible to read an image on the other face (the front side) of the document conveyed along the third conveyance path 33. The document in which the image on the other face is read is discharged through the second discharge port 25 and then stacked on the discharge tray 93 (or the document fall prevention member 95).

In the above embodiments, the third conveyance path 33 and the discharge rollers pair 63 are provided in the inner guide part 17. However, all or some of them may be provided in the outer cover 19. The branch guide 81 may be provided in the outer cover 19.

In the above embodiments, the second conveyance path 32 is formed so as to be curved downward from the branch point, but may be formed so as to be curved upward from the branch point.

The present disclosure has been described with respect to specific embodiments, the present disclosure is not limited to the above embodiments. The above embodiment can be modified by those skilled in the art without departing from the scope and sprit of the present disclosure.

The invention claimed is:

1. A document conveyance apparatus comprising:

a first conveyance path extending linearly and along which a document placed on a sheet feeding tray is conveyed;

a first image reading part which reads an image on one face of the document conveyed along the first conveyance path;

a curved second conveyance path branched from the first conveyance path at a branch point on a downstream side of the first reading part in a conveyance direction of the document;

a third conveyance path branched from the first conveyance path at the branch point and extending linearly in a same extending direction as an extending direction of the first conveyance path;

a branch guide provided at the branch point and guiding the document to the second conveyance path or to the third conveyance path;

a first discharge port through which the document conveyed along the second conveyance path is discharged;

a document stacking section provided with a discharge tray on which the document discharged through the first discharge port is stacked and a whole or a part of which is detachable;

a second discharge port through which the document conveyed along the third conveyance path is discharged; and a tray support part to which the detached whole or part of discharge tray is supported such that the document discharged through the second discharge port is stacked, wherein when the document conveyed along the third conveyance path is discharged through the second discharge port, the whole or part of the discharge tray is detached from the document stacking section and then supported by the tray support part.

2. The document conveyance apparatus according to claim 1, wherein the discharge tray includes a document fall prevention member which prevents the document from being jumped out in a downstream side in a discharge direction of the document, and the document fall prevention member is detachable from the document stacking section.

3. The document conveyance apparatus according to claim 2, wherein the document fall prevention member is displaced between a storage position where the document fall prevention member is stored in the discharge tray and a protruding position where the document fall prevention member is protruded in the downstream side.

4. The document conveyance apparatus according to claim 2, wherein the document fall prevention member has a size smaller than the discharge tray.

5. The document conveyance apparatus according to claim 1, further comprising a second image reading part which read an image on the other face of the document conveyed along the second conveyance path.

6. The document conveyance apparatus according to claim 1, further comprising a third image reading part which read an image on the other face of the document conveyed along the third conveyance path.

* * * * *